US005951336A

United States Patent [19]

Seko et al.

[11] Patent Number: 5,951,336

[45] Date of Patent: Sep. 14, 1999

[54] TERMINAL FITTING

[75] Inventors: Satomi Seko; Masamitsu Chishima; Kenji Okamura; Yoshimasa Wada; Hiroyuki Oka, all of Yokkaichi, Japan

[73] Assignee: Sumitomo Wiring Systems, Ltd., Japan

[21] Appl. No.: 08/898,309

[22] Filed: Jul. 22, 1997

[30] Foreign Application Priority Data

Jul. 25, 1996 [JP] Japan ..... 8-196746

[51] Int. Cl.[6] ..... H01R 13/434

[52] U.S. Cl. ..... 439/745; 439/748

[58] Field of Search ..... 439/745, 744, 439/746, 839, 847, 747, 748, 749

[56] References Cited

U.S. PATENT DOCUMENTS

| | | | |
|---|---|---|---|
| 3,462,726 | 8/1969 | Stark et al. | 439/252 |
| 5,246,390 | 9/1993 | Egenolf . | |
| 5,266,056 | 11/1993 | Baderschneider et al. | 439/745 |

FOREIGN PATENT DOCUMENTS

| | | | |
|---|---|---|---|
| 0 517 076 A2 | 9/1992 | European Pat. Off. . | |
| 0 517 077 A2 | 9/1992 | European Pat. Off. . | |
| 0 517 139 A2 | 9/1992 | European Pat. Off. . | |
| 547396 | 6/1993 | European Pat. Off. | 439/740 |
| 86 08 199 | 6/1986 | Germany . | |
| 8608199 | 6/1986 | Germany | 439/842 |

*Primary Examiner*—Paula Bradley
*Assistant Examiner*—Antoine Ngandjui
*Attorney, Agent, or Firm*—Banner & Witcoff, Ltd.

[57] ABSTRACT

A protecting cover B is provided for a miniature terminal, the upper face having a lance 41 formed by shearing. This lance 41 has a pair of protecting members 42 located in the posterior side thereof, the posterior edges of the protecting members 42 being cut so as to form diagonal edges with respect to the direction of extension of the lance 41. In this way, a portion of the bending space formed under the lance 41 is surrounded by the protecting member 42, thereby preventing entry of foreign matter. As a result, bending and entanglement can be prevented. The cover may have a protruding wall 43 to provide additional protection against external forces.

9 Claims, 4 Drawing Sheets

20
30
A
32
11
14
10
12
12
32
31
21
21a
22
22a
B
41
43
44
45
45
42

TERMINAL FITTING

TECHNICAL FIELD

The present invention relates to a terminal fitting attached of an electrical connector.

BACKGROUND TO THE INVENTION

A terminal fitting usually has a lance formed thereon to prevent removal once it is inserted in a connector housing. Such a lance is formed by shearing out a portion of the external face of the terminal fitting.

In a miniaturized terminal fitting, since the shape of the lance must also miniaturized, a stainless steel protecting cover is provided separately and, since an adequate stopping effect cannot be achieved by the miniaturized lance, a lance is formed on the external face of the protecting cover.

However, simply forming the lance on the terminal fitting or the protecting cover by shearing causes the lance to protrude in an exposed state, thereby making it susceptible to changing shape due to an external force or the like. In particular, during the production process, a lance or electric wire or the like of another terminal fitting may enter the bending space formed under the lance, and this can cause unwanted bending or entanglement. The present invention has been developed after taking the above problem into consideration, and aims to provide a terminal fitting wherein entry of foreign matter into the bending space is prevented.

SUMMARY OF THE INVENTION

According to the invention there is provided an electrical terminal having a resilient fixing lance protruding obliquely from one face thereof, the lance being part-sheared out of the terminal and defining a bending space between the underside thereof and said face, characterized in that said lance further includes a protective wall protruding therefrom to cover at least a portion of said bending space.

The protective wall shields the bending space to an extent sufficient to prevent entanglement with other terminals and wires; thus undesirable bending of the lance is avoided.

The protective wall may be formed at the side or end of the lance, or both, preferably by bending from the sheet material of the lance itself. The wall may extend along the side of the lance to the end, and be formed at an acute angle to the direction of lance extension so as to increase the surface area in contact with a terminal body with which the lance is in use engaged.

The protective wall may be formed on the electrical connector itself or on a protective cover of the terminal. The latter is most useful in the case of a miniaturized terminal.

BRIEF DESCRIPTION OF DRAWINGS

Other features of the invention will be apparent from the following description of several preferred embodiments shown by way of example only in the accompanying drawings in which.

DESCRIPTION OF PREFERRED EMBODIMENTS

Figure 1:
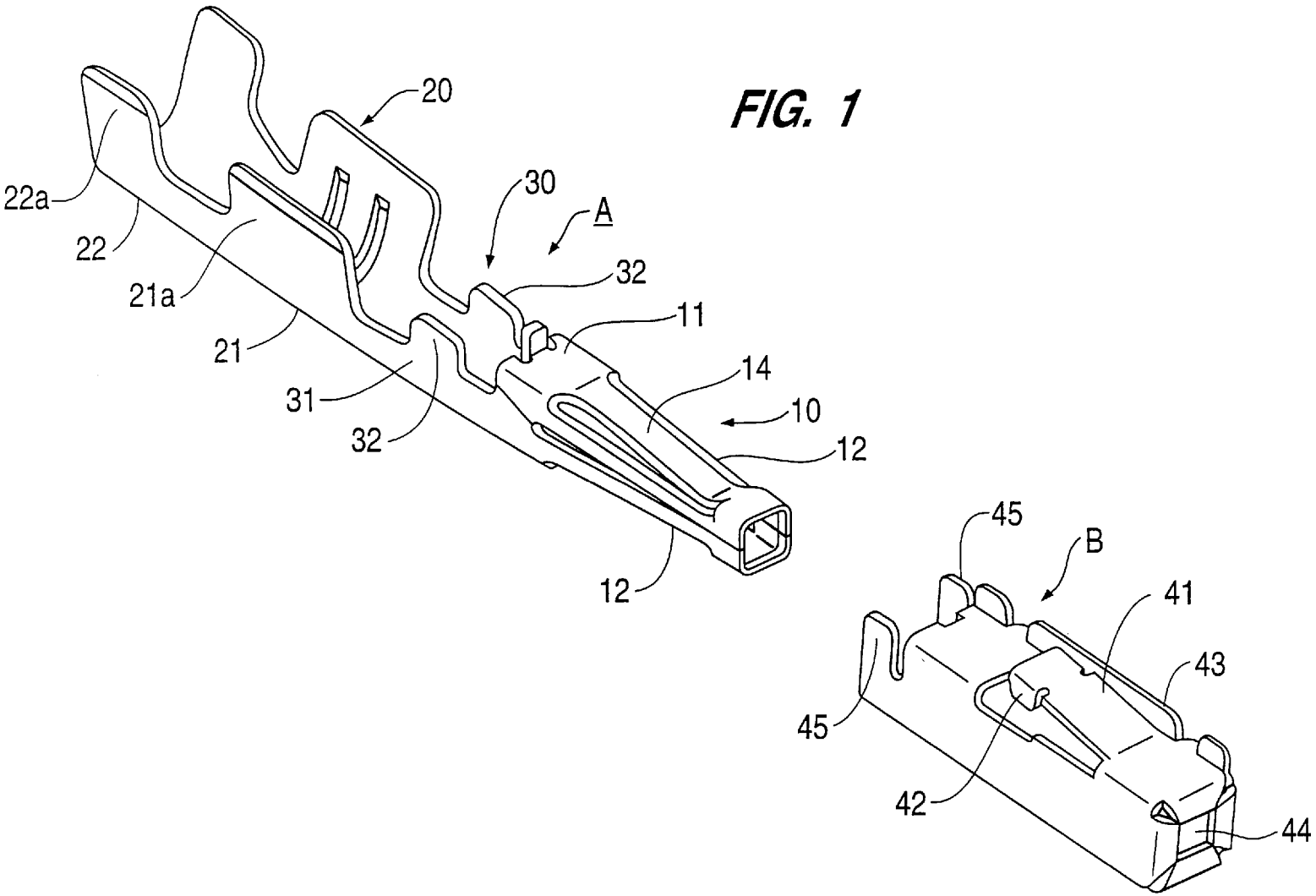
FIG. 1 is a diagonal view of an entirely disassembled first embodiment.

A first embodiment of the present invention relating to a terminal fitting is explained hereinbelow, with reference to FIGS. 1 to 6. As shown in FIG. 1, a female terminal fitting comprises a terminal main body A made from electrically conducting metal plate (for example, a thin copper alloy) that has been bent, and a protecting cover B that covers the terminal main body A.

The main body A is configured so as to be provided with an insertion member 10 into which a corresponding male terminal fitting (not shown) is inserted, and a barrel member 20 connected to the insertion member 10 via a connecting member 30, the terminal of an electric wire being attached by crimping thereto. The barrel member 20 comprises a wire barrel 21 that crimps a wire core of an electric wire, and an insulation barrel 22 connecting to the posterior side (on the left, upper side in FIG. 1) that crimps a covered portion of the electric wire. The barrels 21 and 22 are conventional, and have a shape whereby they protrude upwards as pairs of crimping members 21*a* and 22*a*.

Figure 3:
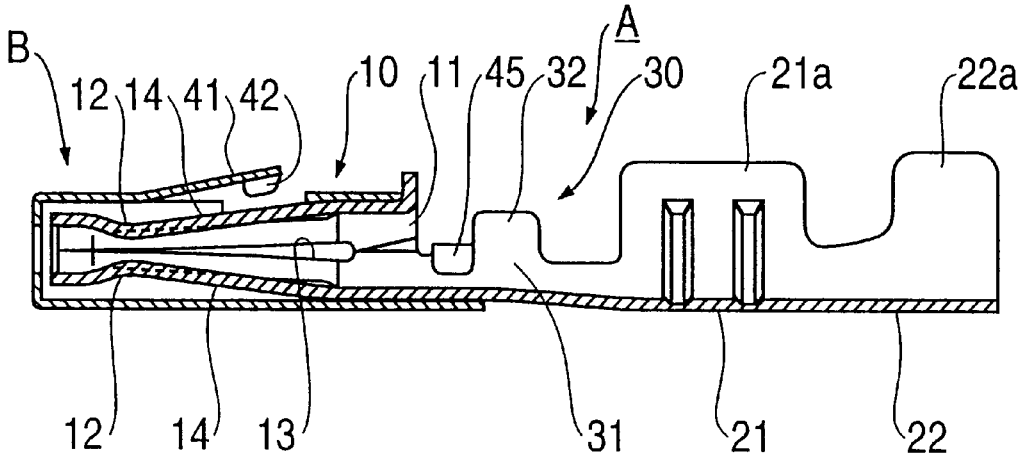
FIG. 3 is a cross-sectional side view of the first embodiment.
Figure 4:
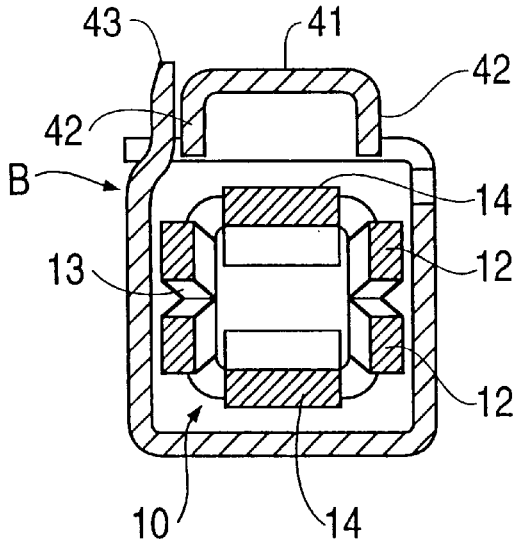
FIG. 4 is a cross-sectional front view of the first embodiment.

The insertion member 10 has an angled tubular shape that narrows off towards the anterior end (the right lower end in FIG. 1), and, as shown in FIG. 3, the insertion member 10 has a partition extending from the anterior end towards the posterior end, the partition dividing the insertion member 10 into upper and lower parts. In other words, the posterior end (the right side in FIG. 3) has a tubular member 11 forming an angled tubular shape, the anterior end (the left side in FIG. 3) having resilient contacts 12 which are channel-shaped. The contacts 12 are formed so as to be connected and to face each other in an up-down direction. Furthermore, a slit 13 is provided between the contacts 12 so as to extend from approximately the centre with respect to the lengthwise direction up to the tubular member 11, the facing faces of the contacts 12 having contacting members 14 formed by bending inwards. When the male terminal fitting is inserted into the insertion member 10, the contacting members 14 are pushed apart and bend, and along with this, the contacts 12 bend slightly in an up-down direction so as to widen from their root portions.

The connecting member 30 is groove shaped and extends from the posterior end of the insertion member 10 to the anterior end of the barrel member 20, facing side walls 31 on the left and right sides having a pair of stabilizers 32 protruding in an upward direction.

Figure 2:
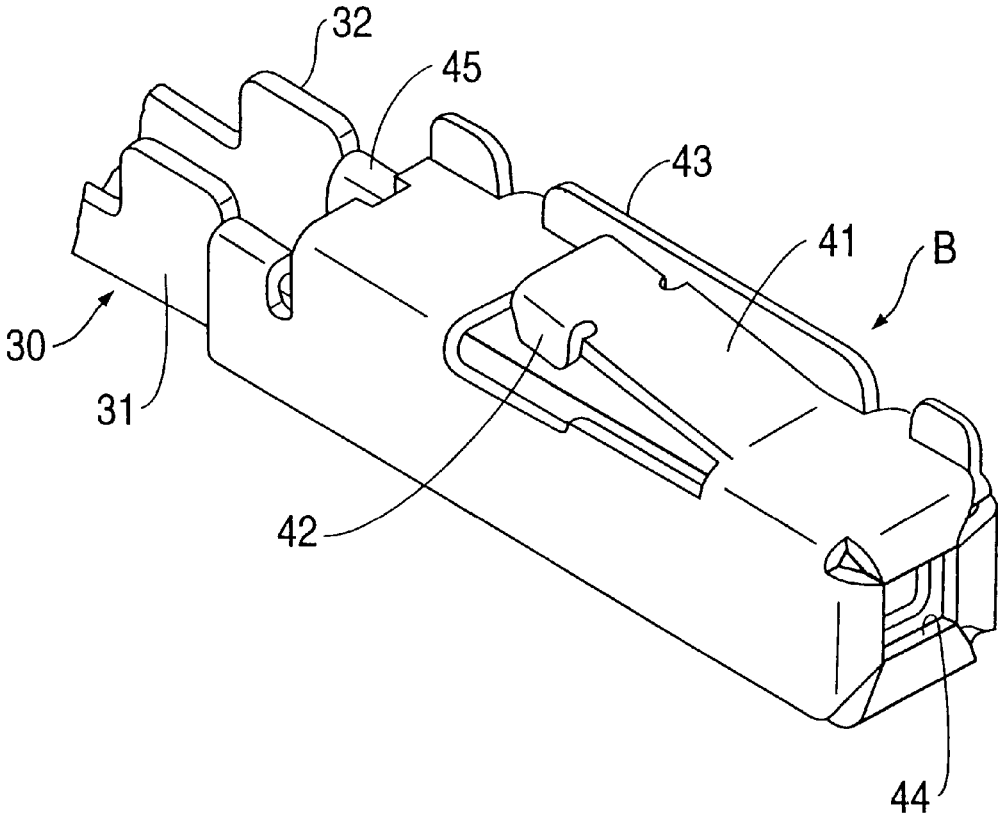
FIG. 2 is a diagonal view of the first embodiment showing the attached protecting cover.

As shown in the lower right-hand side of FIG. 1 and in FIG. 2, the protecting cover B is formed by bending a stainless steel thin metal plate into an angular tubular shape, its lengthwise dimension being slightly larger than the length of the insertion member 10, and its inner dimensions being slightly larger than the outer dimensions of the tubular member 11. In other words, the protecting cover B is insertable from the anterior end on to the insertion member 10 and, in this inserted state, forms a bending space for the elastic contacts 12.

The upper face of the protecting cover B has a lance 41 formed by shearing so as to extend outwards from the anterior end as illustrated. The cut-away posterior end of this lance 41 (the right side in FIG. 3) has protecting members 42 formed by bending the left and right edges downwards. These protecting members 42 comprise the present invention and serve to cover a portion of a bending space of the lance 41 formed by cutting away the upper face of the protecting cover B. Furthermore, the posterior ends of the protecting members 42 are cut diagonally so as to form acute angled edges in the direction of extension of the lance 41.

The right wall of the protecting cover B (the inner side wall in FIG. 1) forms an external wall 43 that has the same height as the upper end of the lance, the external wall 43 encompassing the bending space of the lance 41. The anterior end of the protecting cover B has its opening edges bent inwards, and an insertion hole 44 is formed therein for inserting a male terminal fitting. The posterior end of the protecting cover B has a pair of fixing members 45 protruding upwards. When the protecting cover B is in a fitted state with respect to the insertion member 10, the fixing of the protecting cover B is carried out by making the insertion member 10 overlap with the external walls 31 of the connecting member 30, and the fixing members 45 are bent inwards (see FIG. 2).

Figure 5:
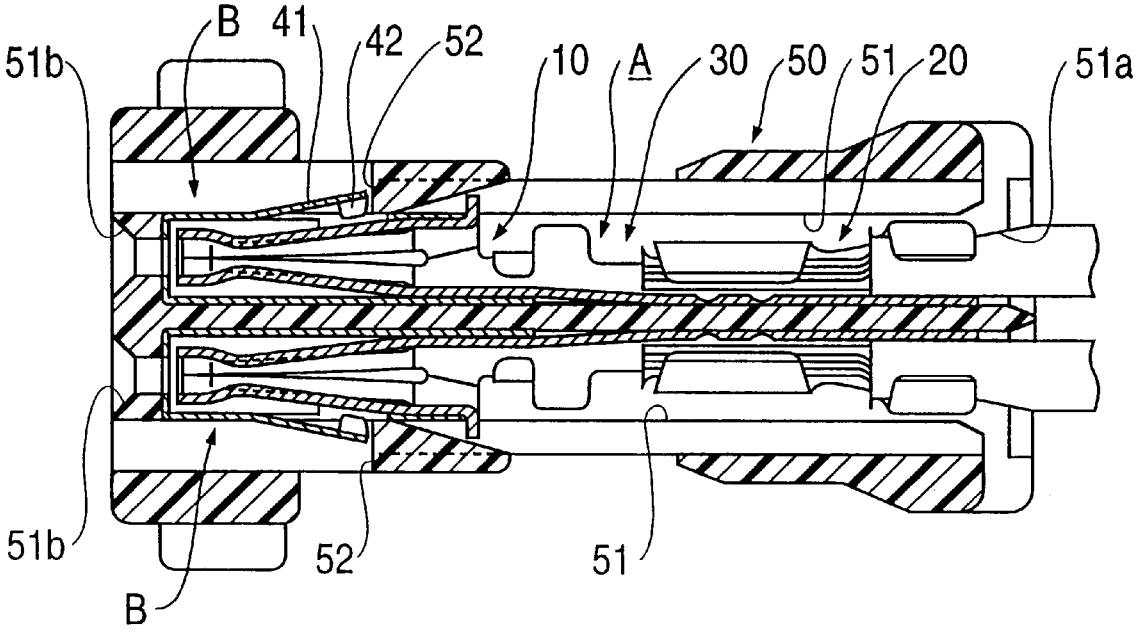
FIG. 5 is a cross-sectional side view showing the first embodiment attached to a connector housing.
Figure 6:
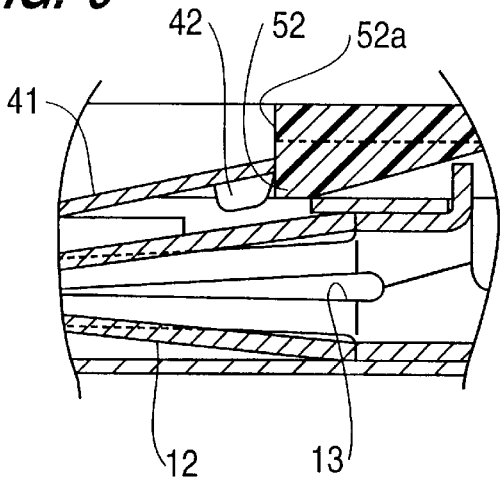
FIG. 6 is a partially enlarged cross-sectional view from the side showing the fitted state of the lance in the first embodiment.

FIG. 5 shows a state whereby the female terminal fitting is inserted in a connector housing 50. In the sideways direction of this connector housing 50 (the up-down direction of FIG. 5), cavities 51 are aligned, the posterior ends of each of these cavities 51 (the right side in FIG. 5) having terminal attachment holes 51*a* for attaching the female terminal fitting, and the anterior end (the left end in FIG. 5) having terminal insertion holes 51*b* for inserting a male terminal fitting. The inner wall faces towards the outer side in the cavities 51 have stopping members 52 formed thereon, and, as shown in FIG. 6, the lance 41 of the female terminal fitting fits with a stopping face 52*a*.

When the lance 41 and the stopping member 52 are in a fitted state, since the posterior edge of the protecting member 42 is cut diagonally, the lance 42 forms a small space between the posterior edge of the protecting member 42 and the stopping face 52*a*, the posterior edge of the lance 41 being in a state whereby it makes contact with the stopping face 52*a*. However, from this state, when the female terminal fitting is pulled in a direction opposite to the insertion direction, the posterior end of the lance 41 fits with the stopping face 52*a* and slides upwards slightly; as a result, the entire posterior end of the protecting wall 42 makes contact with the stopping face 52*a*, so increasing the surface area in contact therewith.

In this manner, in the present embodiment, by forming protecting members 42 on the lance 41, a portion of the bending space of the lance 41 formed on the upper face of the protecting cover B is surrounded. Consequently, during the production process, it becomes difficult for the lance of another terminal fitting or an electric wire or other such foreign body from entering therein, and as a result, a change in shape of the lance due to their entanglement can be prevented.

Furthermore, in the present embodiment, apart from the protecting members, the external wall 43 partially encompasses the bending space. Accordingly, further protection is afforded against foreign matter entering the bending space of the lance 41. Since the external wall 43 is slightly higher than the upper end of the lance 41, it is difficult for the lance 41 to be bent due to an external force.

By forming the posterior end of the protecting member 42 in a diagonal direction, the posterior end as a whole of the lance 41, including the protecting member 42, makes contact with the stopping face 52*a* of the connector housing 50. As a result, the surface area is increased, and prevention of removal of the female terminal fitting becomes more certain. By providing the protecting member 42 in the lance 41, the strength of the lance 41 is increased. By this means as well, prevention of removal of the lance 42 from the connector housing 50 can be effected with greater certainty.

A second embodiment of the terminal fitting of the present invention is explained next with the aid of FIGS. 7 to 9. The terminal fitting of this second embodiment is also a female terminal fitting, the configuration of the insertion member and the protecting cover being arranged to be different from that of the first embodiment. Since the other parts are the same as in the first embodiment, the same numbers are accorded, and an explanation thereof omitted.

Figure 8:
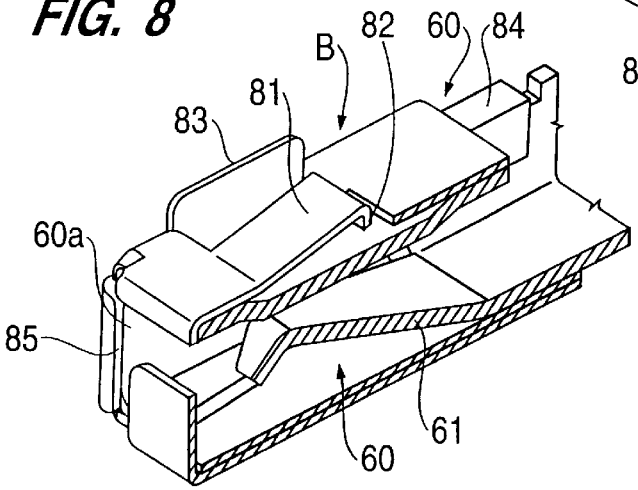
FIG. 8 is a partially cut-away diagonal view of an insertion member of the second embodiment.

As shown in FIG. 8, an insertion member 60 is formed so as to be box-shaped and its anterior face (the more proximate side in FIG. 8) has an opening that serves as an insertion hole 60*a* for inserting a male terminal fitting. Its interior has a resilient contact 61 formed by shearing its base plate, the contact 61 being connected at the posterior end (the right upper side in FIG. 8).

Figure 7:
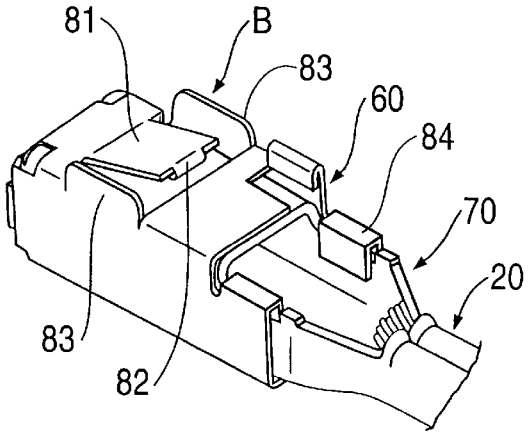
FIG. 7 is a diagonal view of the protecting cover of a second embodiment.

As shown in FIG. 7, a connecting member 70 is formed so as to taper away from the posterior end of the insertion member 60 to the anterior end of the barrel member 20, and the side walls facing each other from the left and right receive fixing members 84 of a protecting cover B, to be described later.

As shown in FIG. 7, the protecting cover B is formed by bending a thin stainless steel plate into a box shape, and its anterior (the proximate side in FIG. 8) and posterior (the more distant side in FIG. 8) faces are open. Furthermore, its dimension in the lengthwise direction is slightly greater than the length of the insertion member 60, and its inner dimension is slightly larger than the external dimension of the insertion member 60.

The upper face of the protecting cover B has a lance 81 formed, as in the first embodiment, by shearing out so that the lance 81 protrudes upwards from the anterior end thereof. This lance 81 has a protecting member 82 formed by bending the posterior end (the proximate direction in FIG. 7) in an approximately perpendicularly downward direction. As in the first embodiment, the member 82 surrounds a portion of the bending space of the lance 81.

Furthermore, portions of the left and right side walls of the protecting cover B protrude slightly so as to be higher than the upper end of the lance 81, thereby forming a pair of external walls 83 which, along with the protecting member 82, surround the bending space of the lance 81. At the anterior end of the protecting cover B, the lower edge of the opening is bent inwards approximately perpendicularly. Accordingly, approximately the lower half of the opening formed at the anterior end is covered, thereby preventing collision of male terminal fittings or the like with the anterior end of the contact 61. Towards the anterior end, the opening constitutes a through hole 85 for allowing insertion of a male terminal fitting. The posterior end of the protecting cover B has a pair of fixing members 84 protruding upwards from left and right side walls. In the state where the protecting cover B is attached to the insertion member 60, these overlap with the connecting members 70 and by bending the fixing members 84 inwards the protecting cover B is attached.

Figure 9:
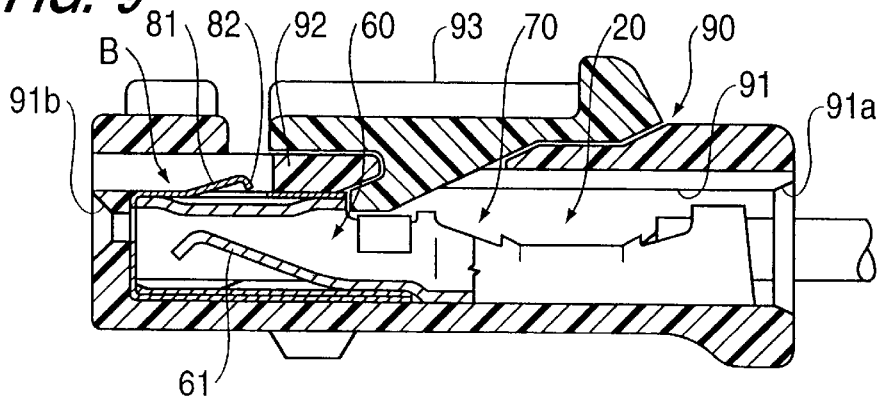
FIG. 9 is a cross-sectional side view of the second embodiment showing an attached state to a connector housing.

FIG. 9 shows a state whereby the female terminal fitting is attached to the connector housing 90. This connector housing 90 has cavities 91 formed in a parallel manner in a sideways direction (the direction perpendicular to the face of the paper), the posterior ends of the cavities 91 (the right side in FIG. 9) having terminal attachment holes 91*a* for attaching the female terminal fitting. The anterior sides (the left side in FIG. 9) have terminal through holes 91*b* for inserting a male terminal fitting. Furthermore, the roof face of each cavity 91 has a stopping member 92 formed by cutting away, the lance 81 of the female terminal fitting therewith. A retainer 93 is attached to the upper face of the connector housing 90. When the retainer 93 is attached, the posterior end of the insertion member 60 of the female terminal fitting is retained by the retainer 93.

In this way, in the present embodiment as well, by forming the protecting member 82, a portion of the bending space of the lance 81 formed on the upper face of the protecting cover B is surrounded. Consequently, in the present embodiment as well, during the production process the entry of a lance or electric wire or the like of another terminal fitting becomes difficult, and as a result change in shape of the lance due to entanglement is prevented.

Further, the external wall 83 also serves to surround a portion of the bending space of the lance 81, and as a result, approximately the entire bending space of the lance 81 is surrounded, thereby more effectively preventing entry of foreign matter in the bending space of the lance 81. The external wall 83 protrudes so as to be slightly higher than the upper edge of the lance 81, as a result of which it becomes difficult for the lance 81 to change shape due to an external force applied from the exterior.

The present invention is not limited to the embodiments described above with the aid of figures. For example, the possibilities described below also lie within the technical range of the present invention.

(1) In the above embodiments, the lance 41 and 81 are formed by being cut out from the protecting cover B. However, it may equally be arranged so that, in the case of a terminal fitting in which a protecting cover is not provided, the lance may be formed by part-shearing a portion of the external face of the terminal fitting itself.

(2) In the above embodiments, examples were discussed where the present invention is applied to a female terminal fitting. However, the present invention may equally apply to a male terminal fitting.

(3) In the above embodiments, the protecting covers B have external walls 43 and 83 provided thereon. However, the configuration may equally be arranged so that the bending space of the lance is surrounded only by the protecting member.

(4) In each of the above embodiments, the protecting cover B is made of stainless steel, but it may equally be made of copper, aluminium, or the like.

In addition, the present invention may be embodied in various other ways without deviating from the scope thereof.

We claim:

1. An electrical terminal having a resilient fixing lance protruding obliquely from one face thereof, the lance being part-sheared out of the terminal and defining a bending space between the underside thereof and a plane extending along said face, characterized in that said lance further includes a protective wall protruding inwardly from a lateral edge of said lance and toward said plane to shield at least a portion of said bending space, said protective wall being free from abutment with sidewalls of said terminal.

2. A terminal according to claim 1 wherein said protective wall further extends from a free end of said lance.

3. A terminal according to claim 1 wherein said protective wall extends to an outermost end of lance, an outermost edge of said wall forming an acute angle with respect to the direction of extension of said lance.

4. A terminal according to claim 1 wherein said protective wall is bent from the lateral edge of said lance.

5. A terminal according to claim 1 wherein opposite protective walls are provided one each on the lateral edges of said lance.

6. A terminal according to claim 5 wherein said opposite protective walls are identical.

7. A terminal according to claim 1 and comprising a terminal body for receiving a corresponding terminal, and a cover (B) for at least a portion of said body, said lance being formed on said cover.

8. A terminal according to claim 7 wherein said cover further includes an upstanding wall alongside said lance and at least equal to the height thereof above said plane.

9. A terminal according to claim 8 wherein said upstanding wall extends along the full length of said lance.

* * * * *